US006367198B1

(12) United States Patent
Rockenbach

(10) Patent No.: US 6,367,198 B1
(45) Date of Patent: Apr. 9, 2002

(54) REVOLVING DOOR WITH NIGHT SURROUND

(75) Inventor: Manfred Rockenbach, Frechen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/639,137

(22) Filed: Aug. 15, 2000

Related U.S. Application Data

(63) Continuation-in-part of application No. PCT/EP98/08521, filed on Dec. 16, 1998.

(51) Int. Cl.[7] ..... E05D 15/02
(52) U.S. Cl. ..... 49/42
(58) Field of Search ..... 49/42, 44, 45; 109/6, 8, 64, 67, 69, 71, 73

(56) References Cited

U.S. PATENT DOCUMENTS

| | | | | |
|---|---|---|---|---|
| 2,029,914 A | * | 2/1936 | Dreher | 49/44 X |
| 4,557,073 A | | 12/1985 | Sandling | |
| 5,634,295 A | | 6/1997 | Bunzl | |
| 5,711,111 A | * | 1/1998 | Nyffenegger et al. | 49/42 |

FOREIGN PATENT DOCUMENTS

| | | | |
|---|---|---|---|
| DE | 131732 | 10/1900 | |
| DE | 164251 | 8/1904 | |
| DE | 3339997 | 5/1984 | |
| DE | 3843174 | 6/1990 | |
| DE | 4310295 | 10/1994 | |
| DE | 19755197 | 5/1999 | |
| EP | 0606193 | 7/1994 | |
| FR | 357401 | 12/1905 | |
| GB | 17427 | * of 1895 | 49/42 |
| GB | 487418 | 6/1938 | |
| GB | 2052612 | 1/1981 | |

* cited by examiner

*Primary Examiner*—Jerry Redman
(74) *Attorney, Agent, or Firm*—Nils H. Ljungman & Associates

(57) ABSTRACT

This invention relates to a revolving door with a plurality of door panels which can be rotated around a central axis inside a cylindrical barrel wall that surrounds them. The invention teaches that one of the door panels or parts thereof can be detached from the position it or they occupy during operation, and can be pivoted and/or moved into a position that forms a night surround, in which it/they close the entrance and/or the exit.

9 Claims, 5 Drawing Sheets

REVOLVING DOOR WITH NIGHT SURROUND

CONTINUING APPLICATION DATA

This application is a Continuation-in-Part application of International Application No. PCT/EP98/08521, filed on Dec. 16, 1998. The United States was an elected state in International Application No. PCT/EP98/08521. International Application No. PCT/EP98/08521 was pending as of the filing date of this application.

BACKGROUND OF THE INVENTION

1. Field of the Invention

This invention relates to a revolving door with a plurality of door panels which in their operating position can be rotated around a central axis inside a cylindrical barrel wall that is adjacent to them on the outside, whereby the barrel wall has at least two interruptions to form at least one entrance and one exit, and the entrance and/or exit can be closed by means of a night surround that forms a component of the door panel.

In other words, a revolving door is comprised of a plurality of door panels, and at least one door panel may be used as a night surround or the like shutter for an entrance or exit that is being served by the revolving door.

2. Background Information

Night surrounds are used for the additional partitioning of revolving doors and are intended to prevent access to a portion of the revolving door between the entrance and the door panels when the revolving door is not in operation. The surrounds of the prior art proposed for this purpose are generally realized so that they run concentrically to a cylindrical wall.

British Patent Application 2 052 612 A discloses a surround device of the type described above, by means of which the inner entrance rather than the outer entrance can be blocked. The object of said British patent application is to prevent persons carrying weapons from entering the building. For this purpose, there is a detector which, when it detects weapons, stops the rotating panels of the revolving door in a position in which the armed person is locked between the rotating panels and a segment of the surrounding cylindrical wall. For this purpose, the inner exit can also be closed by a motor-driven wall segment that moves concentrically to the cylindrical wall. To block the partial segment of the revolving door between the entrance and the door panels, it is therefore necessary to have additional wall segments that can be moved concentrically to the cylindrical wall.

German Patent No. 33 39 997 C2 (U.S. Pat. No. 4,557,073, issued Dec. 10, 1985) also discloses a revolving door system in which door panels equipped with emergency escape doors have curved panels in the area next to the barrel wall that run concentrically to the barrel wall and are in contact against the inside of the barrel wall, whereby the length of said panels extends far enough over the curvature of the barrel wall so that, when the door panels are in the proper position, these panels can be used to close the entrance and/or the exit. It is apparent that this solution requires a great deal of construction work, and that some very heavy masses must be moved, especially during the operation of the door, and that in particular as a result of the diagonally opposite arrangement of the curved panels—which results in a simultaneous closing of the entry and the exit—expensive precautions must be incorporated to make emergency escape possible.

OBJECT OF THE INVENTION

The object of the invention, on a revolving door of the type described above, is to improve the location and configuration of a night surround, i.e. to make the night surround more economical while guaranteeing its reliable operation.

SUMMARY OF THE INVENTION

The invention teaches that this object can be accomplished as disclosed in features of the invention.

The invention teaches that, to achieve the night surround, it is not necessary to have concentrically movable night surround panels that can be moved concentrically to the barrel walls or curved panels that form components of the door panels and are constantly moved together with the door panels, but that after the operation of the revolving door has been ended, a door panel itself or parts of a plurality of door panels are moved out of the specified position they occupy during the operation of the revolving door and are used as a night surround. That means that—apart from additional unlocking or locking mechanisms that may be required and one or more guide rails—no additional material or construction effort is necessary to provide a night surround. A door panel that is already present for use during normal operation therefore has a dual function, namely during operation, the function of the door panel, and when the revolving door panel is not in operation the function of the night surround.

It goes without saying that the night surround, with an appropriate configuration of the mechanical equipment used to rotate or move the door panel out of its specified operating position into the night surround position, need not necessarily be formed from a single door panel. For example, two segments of two neighboring door panels that can be united in the closing position to form the night surround can also be used to achieve the same purpose.

The dependent claims disclose additional characterizing features of the invention.

The invention also teaches that the door panel that forms the night surround panel is detachably connected in the vicinity of the central axis (axis of rotation) to said axis, to a neighboring door panel or to the ceiling and/or floor. structure, and can be coupled in a hinge (or the like mechanism affording pivotal movement) in an area of the barrel wall next to an entrance or exit. That means that to form the night surround, the door panel to be used for that purpose is moved into a position in which it is in contact by means of its closing edge with the barrel wall in the area of the barrel wall that is next to the entrance, so that in this area it can be locked with the ceiling or floor structure, for example, to prevent it from rotating. After the door panel has then been detached in the vicinity of the central axis, the door panel can be pivoted into the night surround position, and can also be locked with the floor and ceiling structure in the vicinity of its edge opposite the axis of rotation.

The invention further teaches that this configuration can be achieved particularly easily if the revolving door has a ceiling structure that rotates along with it, and on which is located a guide rail that guides the night surround panel, so that the free, rotating end of the door panel can be reliably guided in the ceiling structure. The detachable mounting of the door panel used as the night surround in the vicinity of the central axis can be configured in any desired manner. For example, the door panel that forms the night surround can be connected directly in the ceiling and floor structure or optionally to a neighboring door panel.

It is thereby not necessary for the door panel to be mounted directly in the central axis in terms of a geometric location, particularly if, as also taught by the invention, the width of the door panel that forms the night surround panel is greater than the radius of the cylindrical barrel wall. Such a configuration can be particularly desirable if the entrance or exit must not be less than a specified width, and this specified width must be covered by a single door panel that acts as the night surround panel.

In particular for a technical design in which the width of the night surround panel is greater than the radius of the cylindrical barrel wall and the revolving door is realized in the form of a three-panel door, the invention further teaches that one door panel forms the night surround panel and the other two door panels are realized in the form of a one-piece double panel.

This double panel, as also taught by the invention, advantageously has a bow-shaped curvature in the vicinity of the central axis, i.e. in the vicinity of the axis of rotation, whereby the door panel that forms the night surround is elongated so that it extends beyond the central axis and connects with the double panel in the vicinity of the curvature.

Because of the fact that with a ceiling structure which rotates with the door panel, the double panel is already connected to the ceiling structure, the door panel that functions as the night surround can be realized so that it rotates with respect to the double panel—which can be provided with emergency escape doors in the manner of the prior art.

As described above, to achieve the widest possible night closure, it may be advantageous to elongate the door panel that forms the night surround panel so that it extends beyond the central axis (axis of rotation).

In that case, the invention further teaches that the central axis (axis of rotation) intersects the door panel that forms the night surround, whereby the pivot bearing itself can be located on the night surround panel. In other words, the invention teaches that this pivot bearing can be elevated for pivoting into the night surround position.

Alternatively, however, as also taught by the invention, it is also possible with the same realization of the door panel that forms the night surround panel—i.e. in which the central axis of rotation intersects the night surround panel the pivot bearing can be located on an adjacent door panel, preferably on the above mentioned double panel. That means that to rotate the panel, a corresponding connecting rod lock or similar device can be elevated between the door panel that forms the night surround panel and the double panel.

The night surround panel can also be immobilized in the closed position in any desired manner. Thus, the invention further teaches that, assuming that the pivot point (or point or center of rotation) of the night surround panel is formed by a rotational bearing in the ceiling structure, all that is necessary to move the panel into the night surround position is to lock the night surround panel in the vicinity of its axis of rotation with the floor structure, and in the vicinity of its free-rotating end with the ceiling structure and the floor structure.

The door panel can be pivoted either manually or automatically. For an automatic pivoting into and out of the night surround position, the door panel can be moved by a drive mechanism.

The locking of the door panel in its base position or in the night surround position can be automated. For example, when the premises are to be closed, it is possible to move the revolving door into its base position and then to release the locking of the door panel. Then the door panel is moved into the night surround position and simultaneously relocked. When the premises are opened, the procedure is performed in reverse.

The above-discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and nonobviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to possible exemplary embodiments which are schematically illustrated in the accompanying drawings, in which:

FIG. 1A is a schematic top plan view showing additional detail of the Figure shown in FIG. 1;

DESCRIPTION OF THE PREFERRED EMBODIMENTS

Figure 1:
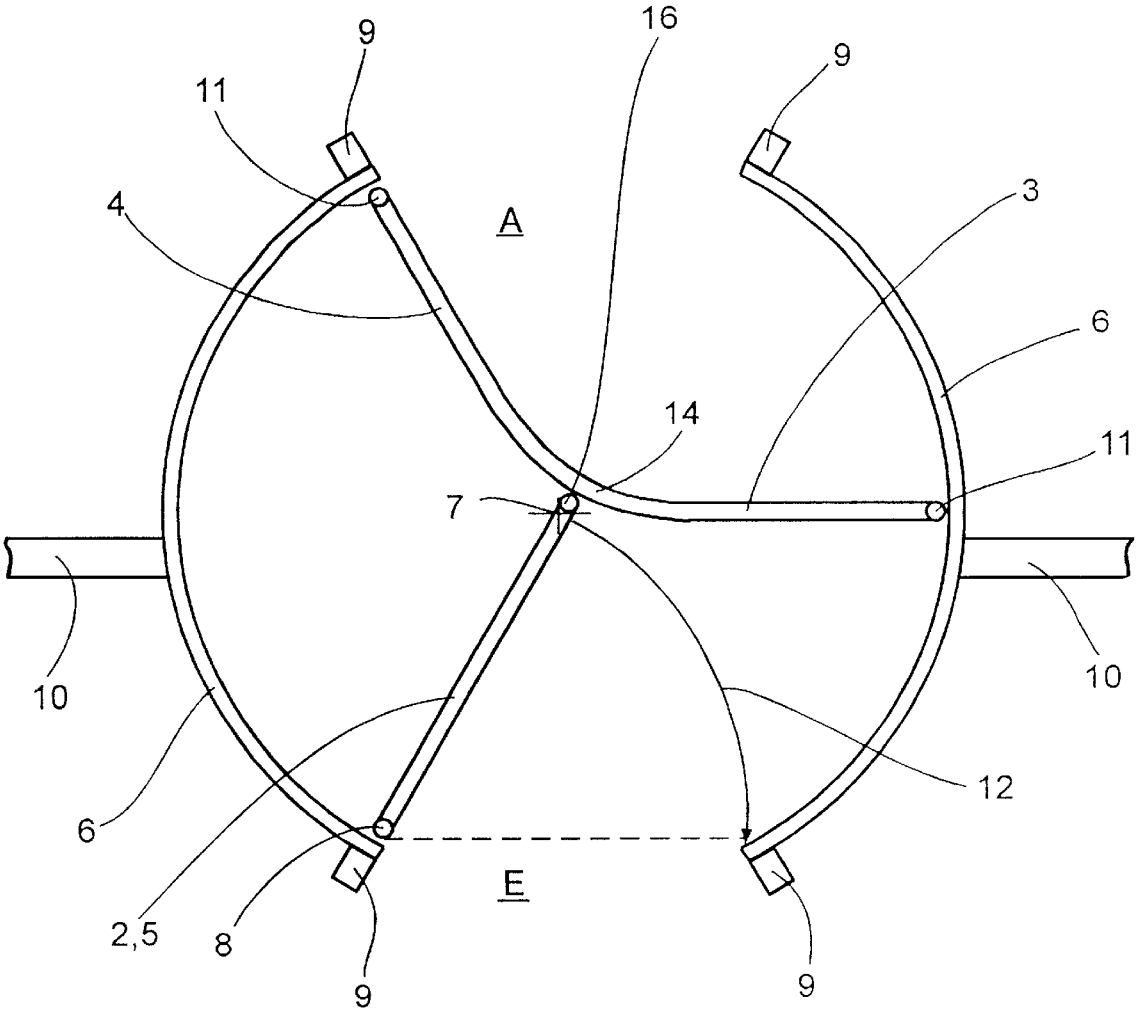
FIG. 1 is a schematic top plan view of a revolving door in its specified operating position.

A revolving door 1 as shown in FIG. 1 has door panels designated 2, 3, 4, of which the door panels 3 and 4 are combined into a single double panel 13. The door panels 2, 3, 4 and the double panel 13 can be rotated around a central axis of rotation 7, and are guided with their free ends on the inside of the cylindrical walls designated 6 by means of the brush seals indicated at 11.

Figure 2:
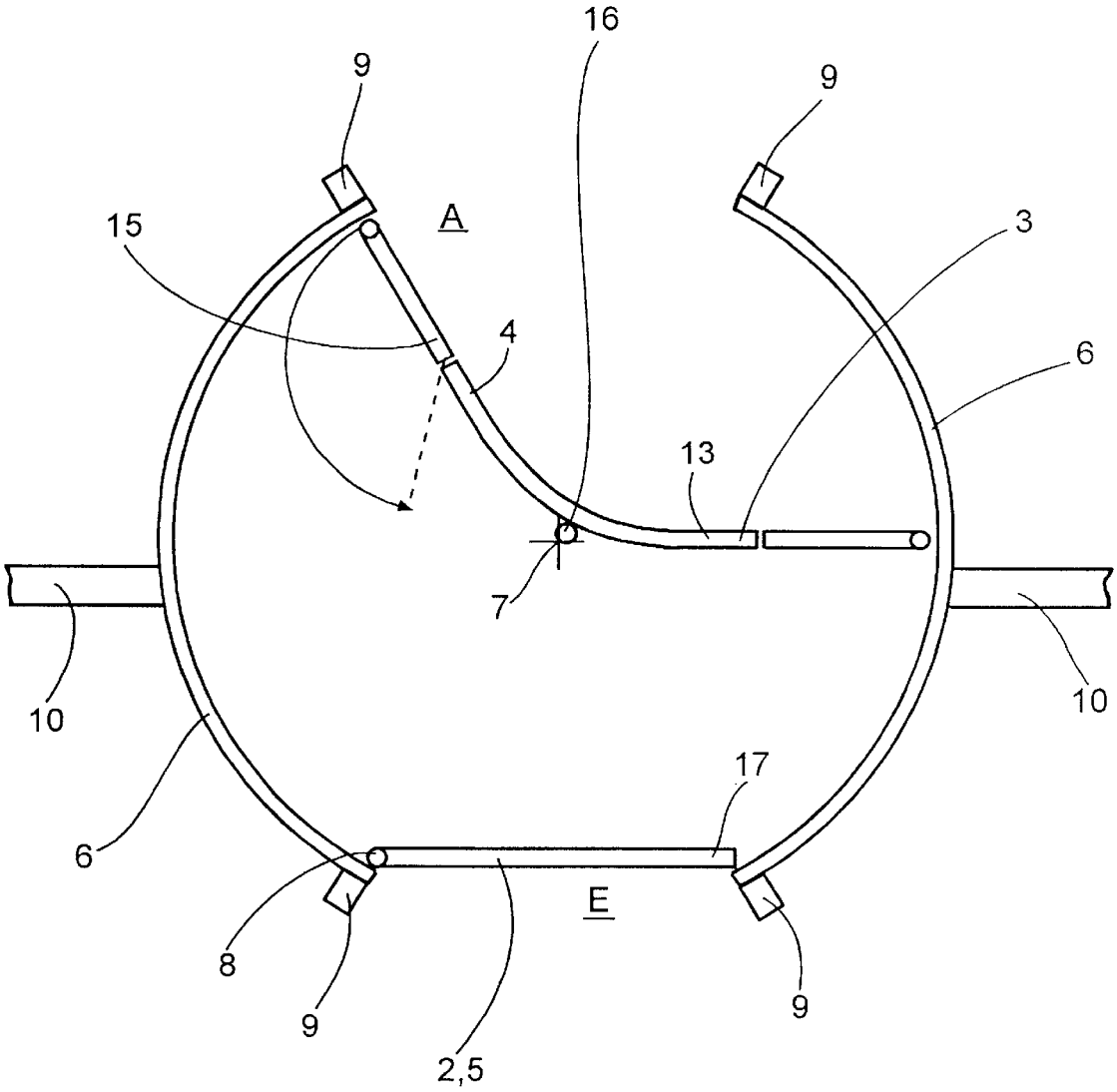
FIG. 2 is a top plan view of the revolving door illustrated in FIG. 1 with a night surround.

Reference numeral 16 is the connecting or attachment point of the door panel 2 to the area with the bow-shaped curvature 14 of the double panel 13. As shown in FIGS. 1 and 2, this connecting point 16 lies outside the axis of rotation 7, i.e. the door panel 2 is extended beyond the axis of rotation 7, so that the axis of rotation 7 intersects the door panel 2.

Between the cylindrical walls 6 to which the connecting walls 10 are adjacent on the outside, an entrance designed E and an exit designated A are formed, which are closed on the sides by uprights identified by reference numeral 9.

With reference to the door panel 2, there is a swivel bearing 8 that is located in the vicinity of the brush seal 11. This swivel bearing 8 is realized, for example, by means of a hinge that runs between the door panel 2 and the ceiling structure.

The mounting point 16 of the door panel 2 can be realized in any desired manner. What is essential is the detachable realization of this connecting point with respect to the ceiling or floor structure or to the neighboring dual panel 13. In contrast to the illustrated embodiment, the connecting point 16 can also coincide directly with the axis of rotation 7.

The purpose of having the width of the door panel 2 extend beyond the axis of rotation 7 in the illustrated exemplary embodiment is so that the widest possible entry opening (entrance E) can be closed by a night surround. For this purpose, the door panel 2 is locked with the floor structure in the vicinity of the hinge 8 in a suitable manner to form a pivot bearing, and is detached from the ceiling structure, the floor structure or the neighboring double panel 13 in the vicinity of the connecting point 16 far enough that it is forcibly guided in the guide rail 12 located in the ceiling structure as it (the door panel 2) pivots around the hinge 8, and can be pivoted into the position illustrated in FIG. 2.

The free end designated 17 of the door panel 2 that is now functioning as the night surround panel 5 is appropriately locked with the ceiling and floor structure, e.g. by means of a connecting rod lock (for example, a deadbolt).

In FIG. 2, emergency escape doors designated 15 are located in the double panel 13. When suitably configured guide means are located in the vicinity of the ceiling structure and there are corresponding unlocking and locking devices, the emergency escape doors 15 themselves or partial segments of one or more door panels 2 to 4 can be used to form a night surround panel 5.

In the embodiment in accordance with FIG. 1A, it is shown that the displacement of the shutter 5 is carried out with the aid of a piston-cylinder unit 19. This piston cylinder unit 19 can supply any displacement movement in radial direction (double-headed arrow 20) that may be required to move the shutter 5 close to the barrel wall 6, that is to an upright 9. In another embodiment of the invention the piston-cylinder unit 19 may also provide the pivoting movement for the shutter 5 to close the entrance E.

Figure 1B:
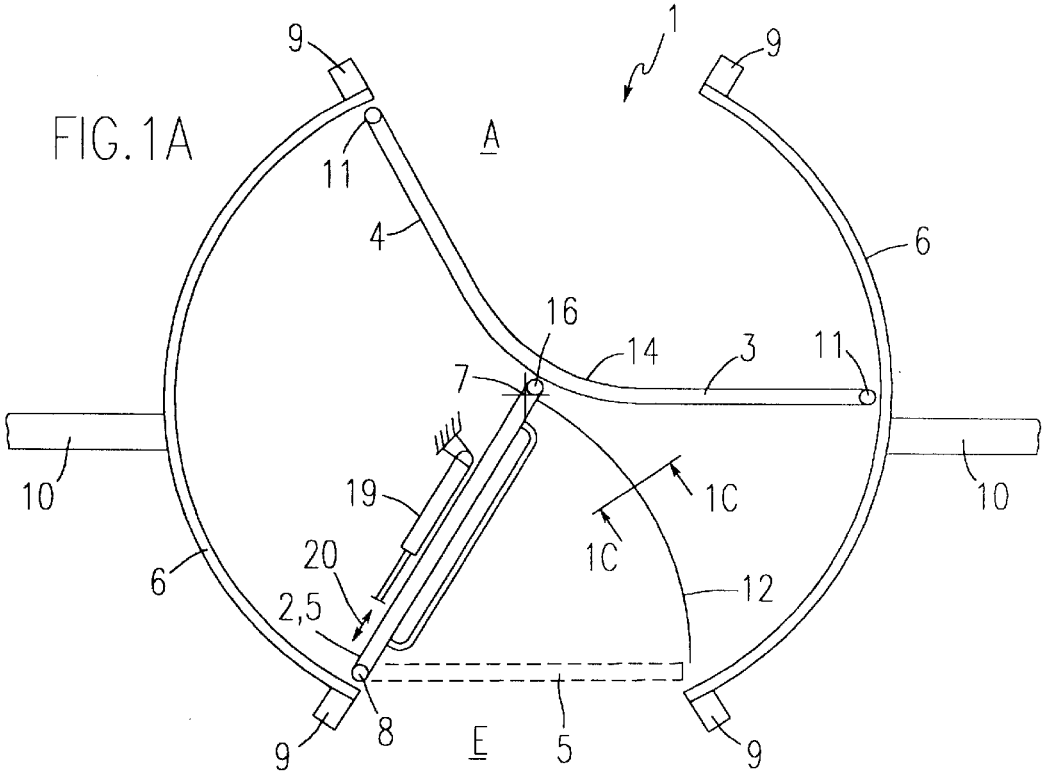
FIG. 1B is a detail of FIG. 1A showing the region of the pivot axis of the revolving door.
Figure 1B:
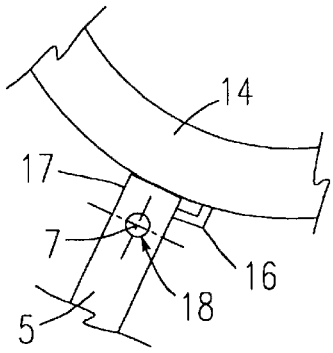
Figure 1C:
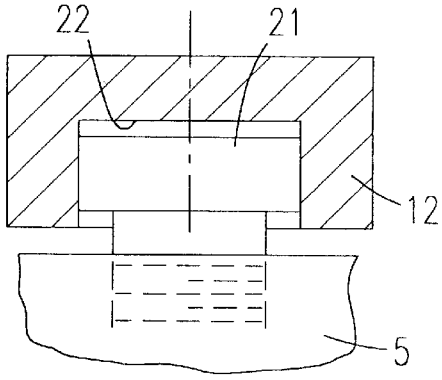
FIG. 1C is a cross-section along line 1C—1C in FIG. 1A.

Thus, with reference to FIG. 1B, the piston-cylinder unit 19 can swing away the edge or free end 17 of the shutter 5 from the bow-shaped curvature 14 when the pivot bearing 18 has been released. Instead of hydraulic equipment, pneumatic equipment or mechanical equivalents may be used to produce the movement of the night shutter panel 5.

As has been mentioned hereinabove, the mounting or securement at point 16 of the door panel 2 (night shutter 5) can be realized in any desired manner. It is essential that this be a detachable, i.e., a releasably securable, realization of this connecting point with respect to the ceiling structure or floor structure or to the neighboring dual panel 13 at the apex of the bow-shaped curvature 14. In another embodiment, so as to guide the shutter 5 in the rail or the like guide device 12, there can be provided a roller 21 or the like element with follows the contour of a slot formation 22.

Figure 2A:
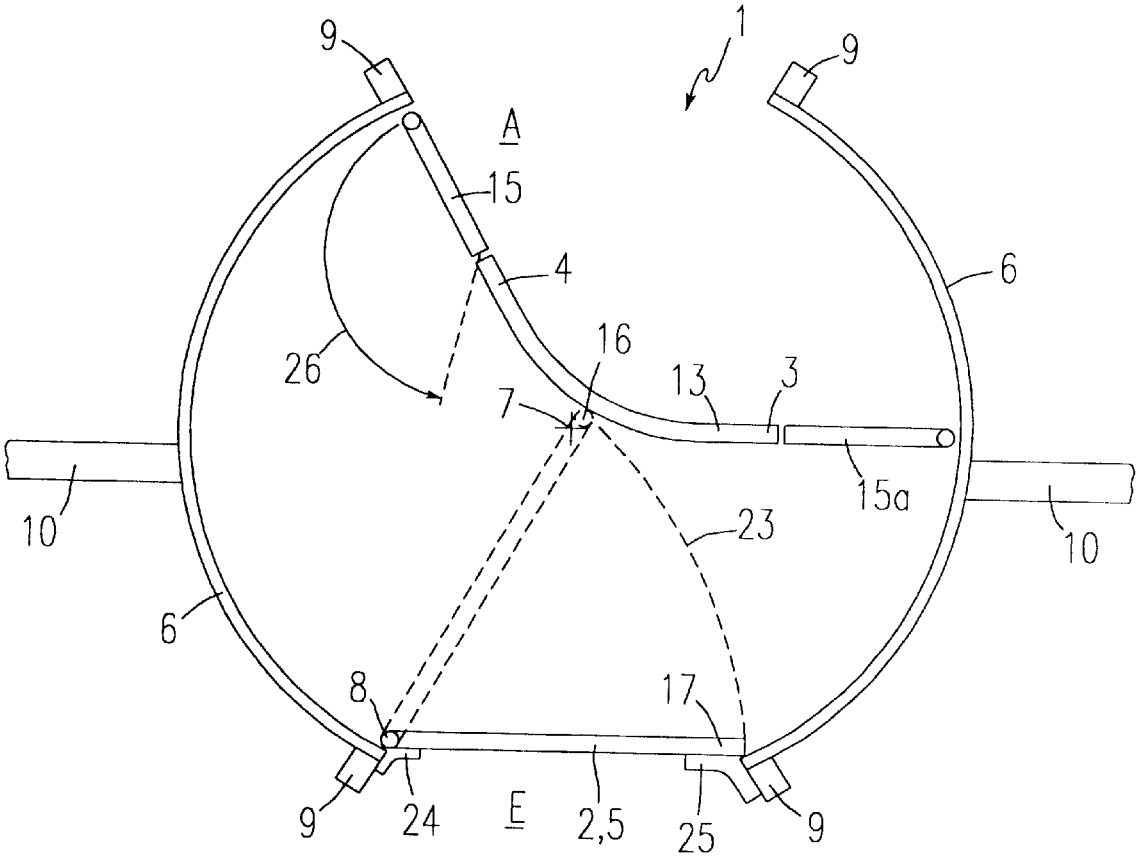
FIG. 2A is top plan view showing additional detail of the Figure shown in FIG. 2.

FIG. 2A shows the movement of the shutter 5 from its position when it is part of the revolving door 1 (dash outline) to the position in which it closes the entrance E. The movement is indicated by arrow 23. The shutter panel 5 can be releasably secured on either side of the entrance by suitable devices generally indicated by reference numerals 24 and 25, for example, at the uprights 9.

Movement of the emergency escape door 15 is indicated by arrow 26. The emergency escape door 15a can also be opened or closed in corresponding manner.

Figure 3:
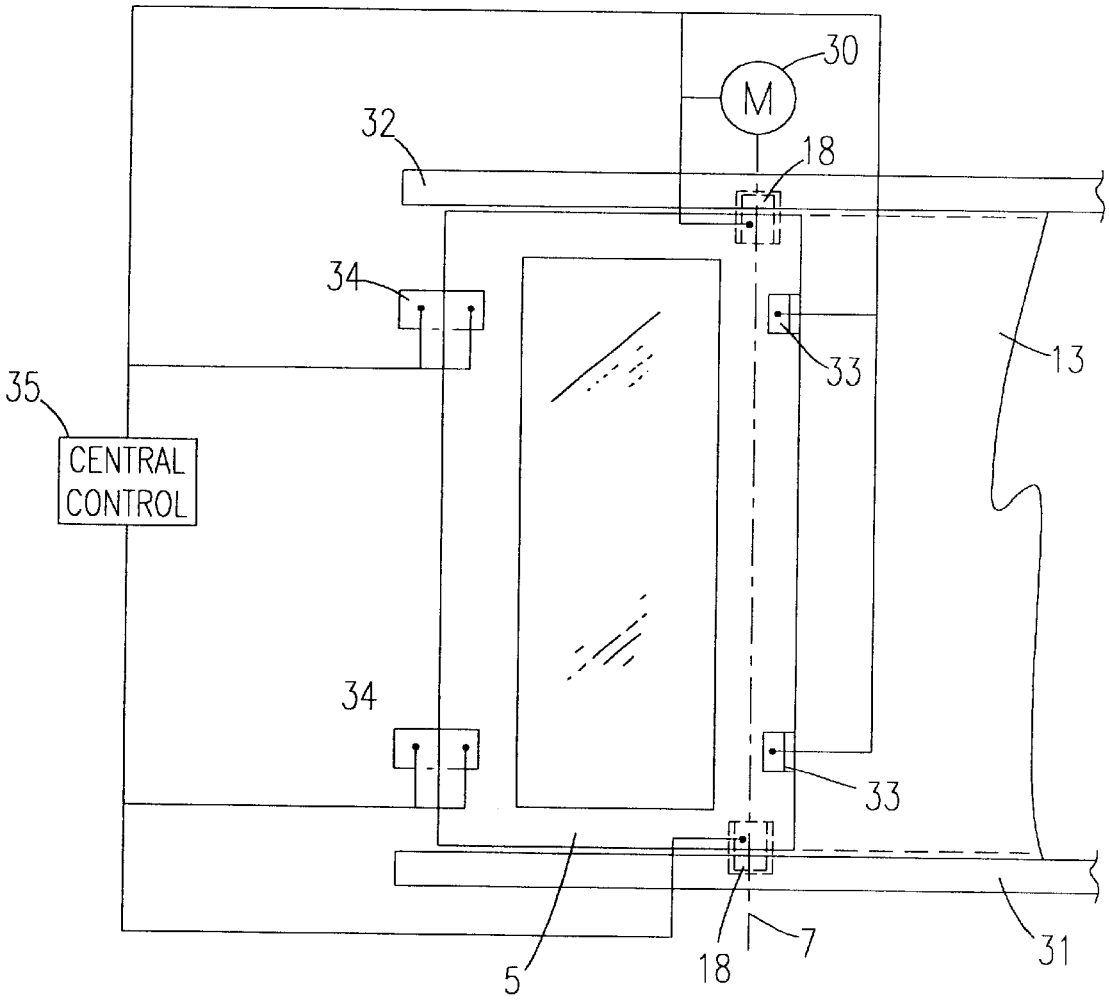
FIG. 3 is an elevation showing the night surround panel and its operation.

FIG. 3 shows an embodiment of the invention with substantially automated actuation for the revolving door 1 with the night shutter panel 5, with rotation being provided about the axis of rotation 7 by a motor apparatus 30. There is provided a floor structure 31 and a ceiling structure 32, either one of which may provide for rotation of the revolving door 1. In one embodiment of the invention both structures may provide for rotation of the revolving door 1.

The pivot bearing 18, of which two may be supplied in another embodiment of the invention, remains engaged with the floor structure 31 and the ceiling structure 32, respectively, and, in consequence, the panel 5 will rotate with the revolving door 1 as long as the releasably securement devices 33 provide an operative connection to, say, the double panel 13.

When the securement devices 33 are disengaged, the panel 5 can be swung or pivoted into its position in which it bridges or similarly closes the entrance opening E, for example, it being within the scope of the invention that at least one of the entrance opening E or exit opening A can be closed by the night shutter panel 5. For this there are provided releasably connecting devices, generally identified by reference numeral 34, which releasably connect the night shutter panel 5 at an adjacent wall formation, for example, an upright 9. Thus, when the connection has been made it allows pivoting movement of the night shutter panel 5, as described above. On the other hand, when the connection has been disabled or severed, the panel 5 may be returned to its position in which it forms part of the revolving door 1. Control of the various movements is executed with a central control 35 which may provide for timed execution of the described operations to suit the requirements of operation of the revolving door 1.

One feature of the invention resides broadly in the revolving door with a plurality of door panels which in their operating position can be rotated around a central axis inside a cylindrical barrel wall that surrounds them externally, whereby the barrel wall has at least two interruptions to form at least one entrance and one exit, and the entrance and/or exit can be closed by means of a night surround that forms a component of the door panel, characterized by the fact that one or more door panels 2, 3, 4 (night surround panel 5) or parts thereof can be pivoted and/or moved from their operating position into a position that closes the entrance E and/or exit A.

Another feature of the invention resides broadly in the revolving door characterized by the fact that the door panel 2 that forms the night surround panel 5 is detachably connected in the vicinity of the central axis (axis of rotation 7) to said axis, to a neighboring door panel 3, 4 or to the ceiling and/or floor structure, and can be connected by means of or in a hinge 8 in an area of the barrel wall 6 that borders an entrance E or exit A.

Yet another feature of the invention resides broadly in the revolving door characterized by the fact that the revolving door 1 has a ceiling structure that rotates with it, on which a guide rail 12 that guides the night surround panel 5 is located.

Still another feature of the invention resides broadly in the revolving door characterized by the fact that the width of the door panel 2 that forms the night surround panel 5 is greater than the radius of the cylindrical barrel wall 6.

A further feature of the invention resides broadly in the revolving door characterized by the fact that the revolving door 1 is realized in the form of a three-panel door, whereby one door panel 2 forms the night surround panel 5 and the other two door panels 3, 4 are realized in the form of a one-piece double panel 13.

Another feature of the invention resides broadly in the revolving door characterized by the fact that the double panel 13 has a bow-shaped curvature 14 in the vicinity of the central axis (axis of rotation 7), that the door panel 2 that forms the night surround 5 is elongated so that it extends beyond the central axis (axis of rotation 7) and is connected to the double panel 13 (connecting point 16) in the vicinity of the curvature 14.

Yet another feature of the invention resides broadly in the revolving door characterized by the fact that each door panel 3, 4 of the double panel 13 has an emergency escape door 15.

Still another feature of the invention resides broadly in the revolving door characterized by the fact that the central axis (axis of rotation 7) intersects the door panel 2 that forms the night surround panel 5, and a pivot bearing located on the night surround panel 5 can be elevated.

A further feature of the invention resides broadly in the revolving door characterized by the fact that the central axis (axis of rotation 7) intersects the door panel 2 that forms the night surround panel 5, and the pivot bearing is located on an adjacent door panel 3, 4, preferably on a double panel 13.

Another feature of the invention resides broadly in the revolving door characterized by the fact that the door panel 2 that forms the night surround panel 5 can be locked with the ceiling structure and the floor structure in a position that closes the entrance E or exit A. Yet another feature of the invention resides broadly in a revolving door comprising: at least one cylindrical wall having an axis of rotation and defining entrance and exit openings, said openings being delimited by terminus formations; a central portion; said central portion being disposed adjacent said axis of rotation; a plurality of door panels; each one of said plurality of door panels being configured to be disposed between said central portion and said at least one cylindrical wall; said plurality of door panels including at least one night shutter panel to close said revolving door so as to prevent entry into said revolving door; apparatus configured to removably secure said at least one night shutter panel to said central portion in a secured position so as to rotate said night shutter panel when in said secured position with said revolving door; apparatus to guide said at least one night shutter panel from its secured position into a position in which it closes entry to said revolving door adjacent one of: said entrance and exit passages; and apparatus configured to removably secure said at least one night shutter panel at least near one terminus of one of: said entrance and exit openings. A further feature of the invention resides broadly in the revolving door comprising: at least one cylindrical wall having an axis of rotation and defining entrance and exit openings; a central portion; said central portion being disposed adjacent said axis of rotation; a plurality of door panels; each one of said plurality of door panels being configured to be disposed between said central portion and said at least one cylindrical wall; said plurality of door panels including at least one night shutter panel to close said revolving door so to prevent entry into said revolving door; apparatus configured to removably secure said at least one night shutter panel to said central portion in a secured position so as to rotate said night shutter panel when in said secured position with said revolving door; apparatus to guide said at least one night shutter panel from its secured position into a position in which it closes entry to said revolving door adjacent one of: said entrance and exit passages; apparatus to move said at least one night shutter panel from its secured position to its closing position; apparatus configured to removably secure said at least one night shutter panel at least near one of: said entrance and exit openings, so that it extends substantially across the selected opening; drive apparatus to impart rotation to said revolving door; and apparatus to control operation of said drive apparatus to impart rotation to said revolving door and operation of said apparatus to move said at least one night shutter between its secured position and its closing position.

Another feature of the invention resides broadly in the revolving door locatable inside of a partially surrounding cylindrical wall defining entrance and exit openings, said revolving door comprising: a plurality of door panels; said plurality of door panels being configured to assume an operating position in which they are rotatable about the central axis of said cylindrical wall; and said plurality of door panels including at least one panel configured to assume the position of a night shutter on being moved from its operating position into a position that bridges at least one of: said entrance and exit openings.

Examples of apparatus and methods which may be used with embodiments of the present invention, may be found in the following U.S. Pat. No. 4,154,023, issued May 15, 1979 to Carroll; U.S. Pat. No. 4,255,900, issued Mar. 17, 1981 to Magnani; U.S. Pat. No. 4,332,108, issued Jun. 1, 1982 to Appelmann; U.S. Pat. No. 4,458,447, issued Jul. 10, 1984 to Heise at al.; U.S. Pat. No. 4,565,030, issued Jan. 21, 1986 to LaSance; U.S. Pat. No. 4,640,046, issued Feb. 3, 1987 to Rushford; U.S. Pat. No. 4,660,322, issued Apr. 28, 1987 to Lowe; U.S. Pat. No. 4,688,350, issued Aug. 25, 1987 to Hattem et al.; U.S. Pat. No. 4,800,679, issued Jan. 31, 1989 to Applemann; U.S. Pat. No. 4,843,761, issued Jul. 4, 1989 to Sandling; U.S. Pat. No. 4,970,825, issued Nov. 20, 1990 to Knarvik; U.S. Pat. No. 4,980,992, issued Jan. 1, 1991 to Liles et al.; U.S. Pat. No. 5,634,295, issued Jun. 3, 1997 to Bunzl; U.S. Pat. No. 5,666,106, issued Sep. 9, 1997 to Nasman; U.S. Pat. No. 5,692,446, issued Dec. 2, 1997 to Becker et al.; U.S. Pat. No. 5,711,111, issued Jan. 27, 1998 to Nyffenegger et al.; U.S. Pat. No. 6,061,960, issued May 16, 2000 to Korai; U.S. Pat. No. 6,076,302, issued Jun. 20, 2000 to Otto; U.S. Pat. No. 6,080,981, issued Jun. 27, 2000 to Payne.

Examples of apparatus and/or methods which may be associated with the embodiments of the present invention are contained in the following U.S. Pat. No. 5,647,173, issued Jul. 15, 1997 to Starck et al.; U.S. Pat. No. 5,653,056, issued Aug. 5, 1997 to Starck; U.S. Pat. No. 5,773,943, issued to Andersen; U.S. Pat. No. 5,987,817, issued Nov. 23, 1999 to Hein.

The components disclosed in the various publications, disclosed or incorporated by reference herein, may be used in the embodiments of the present invention, as well as, equivalents thereof.

The following patents, patent applications and publications are hereby incorporated by reference as if set forth in their entirety herein: U.S. Patent No. 5,773,943, issued on Jun. 30, 1998, having inventor Henrik Andersen; U.S. Pat. No. 5,653,056, issued on Aug. 5, 1997, having inventor Jurgen Stark; U.S. Pat. No. 5,987,817, issued on Nov. 23, 1999, having inventor Christin Hein; U.S. Pat. application Ser. No. 09/546,504, filed on Apr. 11, 2000, having inventor Manfred Rockenbach; and U.S. Pat. No. 5,647,173, issued on Jul. 15, 1997, having inventors Jurgen Stark and Steffen Strunk.

The following patents, patent applications and publications are hereby incorporated by reference as if set forth in their entirety herein: U.S. Pat. No. 3,497,997, having inventor Sheckells; U.S. Pat. No. 4,339,843, having inventor Burnett; U.S. Pat. No. 5,097,454, having inventors Schwarz et al.; U.S. Pat. No. 4,259,810, having inventor Harold E.

West; U.S. Pat. No. 4,341,165, having inventors Calandritti et al.; U.S. Pat. No. 4,785,579, having inventors Sugiyama et al.; U.S. Pat. No. 4,991,347, having inventors Takimoto et al.; U.S. Pat. No. 5,542,211, having inventor Colombo; EP Pat. No. 296,134, having inventor Sandling; U.S. Pat. No. 4,581,849, having inventor Schwarz; U.S. Pat. No. 5,019,756, having inventor Schwarz; U.S. Pat. No. 4,628,496, having inventor Lee; U.S. Pat. No. 3,766,686, having inventor Scheckells; U.S. Pat. No. 3,897,651 , having inventor Sheckells; and U.S. Pat. No. 4,785,580, having inventor Olesen.

Examples of toothed belts, which may be used in embodiments of the present invention may be found in the following U.S. Pat. No. 5,178,586, issued Jan. 12, 1993 to Mizuno, et al.; U.S. Pat. No. 5,181,889, issued Jan. 26, 1993 to Maruyama, et al.; U.S. Pat. No. 5,184,352, issued Feb. 9, 1993 to Maufette; U.S. Pat. No. 5,209,961, issued May, 11, 1993 to Yukoi; No. 5,234,387, issued Aug. 10, 1993 to Fujiwara, et al.; U.S. Pat. No. 5,306,213, issued Apr. 26, 1994 to Nakajima, et al.; U.S. Pat. No. 5,322,479, issued Jun. 21, 1994 to Le Devehat; and U.S. Pat. No. 5,342,252, issued Aug. 30, 1994 to Fujiwara, et al.

Examples of brakes and electromagnetic brakes which may be used in embodiments of the drive system for the present invention, may be found in the following U.S. Pat. No. 563 5,185,542, issued Feb. 9, 1993 to Lazorchak; U.S. Pat. No. 5,186,286, issued Feb. 16, 1993 to Lindberg; U.S. Pat. No. 5,234,083, issued Aug. 10, 1993 to Lee; U.S. Pat. No. 5,275,261, issued Jan. 4, 1994 to Vranish; and U.S. Pat. No. 5, 368,138, issued Nov. 29, 1994 to Kuivamaki.

Examples of curved tracks or guides which may be used with embodiments of the present invention may be found in the following U.S. Pat. No. 5,184,864, issued Feb. 9, 1993 to Teigen et al.; U.S. Pat. No. 5,189,837, issued Mar. 2, 1993 to Ienaga; U.S. Pat. No. 5,195,437, issued Mar. 23, 1993 to Wallace et al.; U.S. Pat. No. 5,238,283, issued Aug. 24, 1993 to Teigen; and U.S. Pat. No. RE 34360, issued Aug. 31, 1993 to Carlson, et al.

Examples of revolving doors, components of which may be incorporated in embodiments of the present invention, may be found in the following U.S. Pat. No. 5,187,895, issued Feb. 23, 1993 to Huber; U.S. Pat. No. 5,201,142, issued Apr. 13, 1993 to Rouwendaal; U.S. Pat. No. 5,201,906, issued Apr. 13, 1993 to Schwarz et al.; U.S. Pat. No. 5,203,111, issued Apr. 20, 1993 to Huber et al.; U.S. Pat. No. 5,235,783, issued Aug. 17, 1993 to Huber et al.; and U.S. Pat. No. 5,357,711, issued Oct. 25, 1994 to Trikilis.

Various spline fittings and couplings which may be used in conjunction with the present invention are to be found in U.S. Pat. No. 5,181,570, issued to Allwin, et al. on Jan. 26, 1993 and entitled "Liner Hanger Assembly" ; U.S. Pat. No. 5,183,132, issued to Fujisawa on Feb. 2, 1993 and entitled "Power Transfer Device Having Center Differential Gear for Four-Wheel Drive Vehicle"; U.S. Pat. No. 5,186,573, issued to Flotow on Feb. 16, 1993 and entitled "Coupling for Connecting Shafts"; and U.S. Pat. No. 5,269,662, issued to Denton, et al. on Dec. 14, 1993 and entitled "Aircraft Air Conditioner Compressor Drive and Mounting Apparatus", each of the above-referenced U.S. patents being hereby expressly incorporated by reference herein.

A coupling for a revolving door which may be employed in conjunction with the present invention is disclosed in U.S. Pat. No. 5,201,142, issued to Rouwendaal on Apr. 13, 1993 and entitled "Revolving Door", the above-referenced U.S. patent being hereby expressly incorporated by reference herein.

Some examples of guide rails or systems for door, wall, or partition systems that possibly may be utilized or incorporated in at least one possible embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,759,099, issued to inventors Morano et al. on Jul. 26, 1988; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, or door systems and mechanisms and devices for their operation that possibly may be utilized or incorporated in at least one possible embodiment of the present invention may be found in the following U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of drives or electromechanical or electrohydraulic drives that possibly may be utilized or incorporated in at least one possible embodiment of the present invention may be found in the following U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,521,400, issued to inventor Schultze on Oct. 12, 1993; U.S. Pat. No. 5,080,635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of guides, rollers, guide elements, or guide arrangements that possibly may be used in at least one possible embodiment of the present invention may be found in the following U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,991,257, issued to inventor Eutebach on Feb. 12, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625, issued to inventor Dulcher on May 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022, issued to inventors Roos et al. on Nov. 17, 1987; U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Eriksson on Mar. 25, 1986; U.S. Pat. No. 4,565,031, issued to inventor Sakamoto on Jan. 21, 1986; U.S. Pat.

No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on Dec. 4, 1979; U.S. Pat. No. 4,064,593, issued to inventor Helmick on Dec. 27, 1977; and U.S. Pat. No. 4,063,388, issued to inventor Little on Dec. 20, 1977.

Some examples of turnouts or turnout switches that possibly may be utilized or incorporated in at least one possible embodiment of the present invention may be found in the following U.S. Pat. No. 5,577,691, issued to inventors Erich et al. on Nov. 26, 1996; U.S. Pat. No. 5,375,797, issued to inventor Willow on Dec. 27, 1994; U.S. Pat. No. 4,970,964, issued to inventors Burg et al. on Nov. 20, 1990; U.S. Pat. No. 4,970,962, issued to inventors Burg et al. on Nov. 20, 1990; U.S. Pat. No. 4,890,804, issued to inventors Teramoto et al. on Jan. 2, 1990; and No. 4,005,839, issued to inventor Frank on Feb. 1, 1977.

Some examples of linkages or actuator arms that possibly may be utilized or incorporated in at least one possible embodiment of the present invention may be found in the following U.S. Pat. No. 5,417,013, issued to inventor Tillmann on May 23, 1995; U.S. Pat. No. 5,163,494, issued to inventors MacNeil et al. on Nov. 17, 1992; U.S. Pat. No. 5,149,180, issued to inventors Haab et al. on Sep. 22, 1992; U.S. Pat. No. 5,121,976, issued to inventors Haab et al. on Jun. 16, 1992; U.S. Pat. No. 5,058,238, issued to inventor Lautenschlager on Oct. 22, 1991; U.S. Pat. No. 4,821,375, issued to inventor Kozon on Apr. 18, 1989; U.S. Pat. No. 4,759,099, issued to inventors Morano et al. on Jul. 26, 1988; U.S. Pat. No. 4,669,147, issued to inventor Suchanek on Jun. 2, 1987; U.S. Pat. No. 4,419,787, issued to inventor Lieberman on Dec. 13, 1983; U.S. Pat. No. 4,285,094, issued to inventor Levings, Jr. on Aug. 25, 1981; U.S. Pat. No. 4,184,382, issued to inventor Redman on Jan. 22, 1980; and U.S. Pat. No. 4,080,687, issued to inventor Jentsch on Mar. 28, 1978.

Some examples of sensors, sensor systems, pressure sensing apparatuses, and/or strain gauges that possibly may be utilized or incorporated in at least one possible embodiment of the present invention may be found in the following U.S. Pat. No. 5,770,934, issued to inventor Theile on Jun. 23, 1998; U.S. Pat. No. 5,625,266, issued to inventor Stark on Apr. 29, 1997; U.S. Pat. No. 5,428,278, issued to inventors Bollengier et al. on Jun. 27, 1995; U.S. Pat. No. 5,303,593, issued to inventor Kremidas on Apr. 19, 1994; U.S. Pat. No. 5,287,757, issued to inventors Polaert et al. on Feb. 22, 1994; U.S. Pat. No. 5,251,400, issued to inventor Schultze on Oct. 12, 1993; U.S. Pat. No. 5,241,308, issued to inventor Young on Aug. 31, 1993; U.S. Pat. No. 5,199,519, issued to inventors Polaert et al. on Apr. 6, 1993; U.S. Pat. No. 5,191,798, issued to inventors Tabata et al. on Mar. 9, 1993; U.S. Pat. No. 5,186,060, issued to inventor Marlier on Feb. 16, 1993; U.S. Pat. No. 5,142,152, issued to inventor Boiucaher on Aug. 25, 1992; U.S. Pat. No. 4,815,046, issued to inventor Dorr on Mar. 21, 1989; U.S. Pat. No. 4,779,240, issued to inventor Dorr on Oct. 18, 1988; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of revolving door systems and apparatus and methods of operation therefor that possibly may be used in at least one possible embodiment of the present invention may be found in the following U.S. Pat. No. 5,773,943, issued to inventor Andersen on Jun. 30, 1998; U.S. Pat. No. 5,789,887, issued to inventor Elischewski on Aug. 4, 1998; U.S. Pat. No. 5,653,056, issued to inventor Stark on Aug. 5, 1997; and U.S. Pat. No. 5,647,173, issued to inventors Stark et al. on Jul. 15, 1997.

Further examples of general components relating to revolving doors may be found in the following patent publications: Federal Republic of Germany 4 124 282 (Dorma GmbH); Federal Republic of Germany 3 934 662 (Gallenschutz Metallbau GmbH); Federal Republic of Germany 4 207 705 (Dorma GmbH); U.S. Pat. No. 4,581,849 (Schwarz); U.S. Pat. No. 4,154,023 (Carroll); and U.S. Pat. No. 4,952,080 (Boiucaner et al.).

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding international patent publication application, namely, International Application No. PCT/EP98/08521, filed on Dec. 16, 1998, having inventor Manfred Rockenbach, as well as its published equivalents, and other equivalents or corresponding applications, if any, in corresponding cases in the Federal Republic of Germany and elsewhere, and the references cited in any of the documents cited therein, are hereby incorporated by reference as if set forth in their entirety herein.

The details in the patents, patent applications and publications may be considered to be incorporable, at Applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A revolving door comprising:

at least one cylindrical wall having an axis of rotation and defining entrance and exit openings, said openings being delimited by terminus formations;

a central portion;

said central portion being disposed adjacent said axis of rotation;

a plurality of door panels;

each one of said plurality of door panels being configured to be disposed between said central portion and said at least one cylindrical wall;

said plurality of door panels including at least one night shutter panel to close said revolving door so as to prevent entry into said revolving door;

apparatus configured to removably secure said at least one night shutter panel to said central portion in a secured position so as to rotate said night shutter panel when in said secured position with said revolving door;

apparatus to guide said at least one night shutter panel from its secured position into a position in which it closes entry to said revolving door bridging across one of: said entrance opening and exit openings;

apparatus configured to removably secure said at least one night shutter panel bridging across the terminus formation of one of: said entrance and exit openings; and said plurality of door panels comprises a three-panel door, whereby one door panel forms said night shutter and the other two door panels are configured as a one-piece double panel.

2. A revolving door locatable inside of a partially surrounding cylindrical wall defining entrance and exit openings, said revolving door comprising:

a plurality of door panels;

said plurality of door panels being configured to assume an operating position in which they are rotatable about the central axis of said cylindrical wall;

said plurality of door panels including at least one panel configured to assume the position of a night shutter on being moved from its operating position into a position that bridges across one of: said entrance and exit openings; and said plurality of door panels comprises a three-panel door, whereby one door panel forms said night shutter panel and the other two door panels are configured as a one-piece double-panel.

3. The revolving door according to claim 2 wherein said double panel includes a bow-shaped curvature adjacent said central axis of rotation; and said night shutter panel is of such a radial length so that it extends adjacent from said cylindrical wall to beyond the central axis of rotation and is connected to said double panel adjacent said curvature of said double panel.

4. The revolving door according to claim 3 wherein each door panel of said double panel has an emergency escape door.

5. The revolving door according to claim 4 and further comprising guide formations to guide said emergency escape doors in the vicinity of a ceiling structure and unlocking and locking devices to equip said emergency escape doors as a night shutter panels.

6. The revolving door according to claim 3 wherein said axis of rotation intersects said night shutter, and further comprising a pivot bearing operatively connected to said night shutter panel for rotation in its operating position, said pivot bearing being configured to release said night shutter so that said night shutter assumes its position in which it closes one of: said entrance and exit openings.

7. The revolving door according to claim 6 wherein said axis of rotation intersects said night shutter panel, and said pivot bearing is located on an adjacent door panel.

8. The revolving door according to claim 7 wherein said pivot bearing is connectable to said double panel.

9. A revolving door comprising:

at least one cylindrical wall having an axis of rotation and defining entrance and exit openings;

a central portion;

said central portion being disposed adjacent said axis of rotation;

a plurality of door panels;

each one of said plurality of door panels being configured to be disposed between said central portion and said at least one cylindrical wall;

said plurality of door panels including at least one night shutter panel to close said revolving door so to prevent entry into said revolving door;

apparatus configured to removably secure said at least one night shutter panel to said central portion in a secured position so as to rotate said night shutter panel when in said secured position with said revolving door;

apparatus to guide said at least one night shutter panel from its secured position into a position in which it closes entry to said revolving door adjacent one of: said entrance and exit passages;

apparatus to move said at least one night shutter panel from its secured position to its closing position;

apparatus configured to removably secure said at least one night shutter panel at least near one of: said entrance and exit openings, so that it extends substantially across the selected opening;

drive apparatus to impart rotation to said revolving door;

apparatus to control operation of said drive apparatus to impart rotation to said revolving door and operation of said apparatus to move said at least one night shutter between its secured position and its closing position; and said plurality of door panels comprises a three-panel door, whereby one door panel forms said night shutter panel and the other two door panels are configured as a one-piece double panel.

* * * * *

UNITED STATES PATENT AND TRADEMARK OFFICE

CERTIFICATE OF CORRECTION

PATENT NO. : 6,367,198 B1
DATED : April 9, 2000
INVENTOR(S) : Manfred Rockenbach It is certified that error appears in the above-identified patent and that said Letters Patent is hereby corrected as shown below:

Column 9,
Line 26, after "No." delete "563".

Column 10,
Line 55, after "inventor", delete "Dulcher" and insert -- Dilcher --.

Column 11,
Line 62, before "on", delete "Boiucaher" and insert -- Boiucaner --.

Signed and Sealed this

Fourteenth Day of January, 2003

JAMES E. ROGAN
*Director of the United States Patent and Trademark Office*